US009550214B2

(12) United States Patent
Harpel

(10) Patent No.: US 9,550,214 B2
(45) Date of Patent: Jan. 24, 2017

(54) SORTING AND BAGGING APPARATUS AND METHOD

(71) Applicant: Bryan Harpel, Jamison, PA (US)

(72) Inventor: Bryan Harpel, Jamison, PA (US)

( * ) Notice: Subject to any disclaimer, the term of this patent is extended or adjusted under 35 U.S.C. 154(b) by 0 days.

(21) Appl. No.: 14/705,179

(22) Filed: May 6, 2015

(65) Prior Publication Data

US 2016/0325314 A1 Nov. 10, 2016

(51) Int. Cl.
*B07B 15/00* (2006.01)
*B07B 1/02* (2006.01)
*B65B 1/06* (2006.01)

(52) U.S. Cl.
CPC ..... *B07B 15/00* (2013.01); *B07B 1/02* (2013.01); *B65B 1/06* (2013.01)

(58) Field of Classification Search
CPC ..... B65B 1/06; B65B 63/08; B67C 3/222; B07B 15/00; B07B 1/02; A01C 1/025
USPC ..... 53/428
See application file for complete search history.

(56) References Cited

U.S. PATENT DOCUMENTS 1,007,050 A * 10/1911 Bascom ..... A01G 31/02 47/14
3,570,210 A * 3/1971 Pinnolis ..... B65B 19/34 53/236
5,402,751 A * 4/1995 De La Chevrotiere ..... A01K 1/0114 119/166
5,517,947 A * 5/1996 Christman ..... A01K 1/0114 119/165
5,622,266 A * 4/1997 Curtis ..... B07B 1/005 209/235
6,095,088 A * 8/2000 Savicki ..... A01K 1/0114 119/166
6,295,948 B1 * 10/2001 Bowron ..... A01K 1/0107 119/165
6,312,029 B1 * 11/2001 Renforth ..... A01K 1/0114 209/418
6,935,512 B1 * 8/2005 Meldahl ..... A47J 37/1223 209/235

(Continued)

FOREIGN PATENT DOCUMENTS

GB 696445 A 9/1953

OTHER PUBLICATIONS

Soil Sifter 2-in-1 Sieve, www.GrowOrganic.com.
Wooden Pollen Sifter Kief Box—3-part, www.grasscity.com.

*Primary Examiner* — Sameh Tawfik
(74) *Attorney, Agent, or Firm* — Massina Pat & TM Law PLLC

(57) ABSTRACT

A sorting and bagging apparatus including a container defining an internal chamber with an opening thereinto and a lid configured to be positioned on the container. The lid defines a through opening aligned with the opening into the container. A basket extends through the through opening and is supported by the lid. The basket has sidewalls and a bottom surface and at least the bottom surface has a plurality of passages therethrough. A funnel having a funnel body extending between an inlet edge and an outlet edge is secured relative to the basket such that the inlet edge extends along the basket bottom surface wherein a sorting chamber is defined between the basket sidewalls, the basket bottom surface and the funnel. The lid is configured to be tilted such that contents within the sorting chamber pass from the sorting chamber to the funnel and out of the funnel at the outlet edge.

13 Claims, 5 Drawing Sheets

(56) References Cited

U.S. PATENT DOCUMENTS

| | | | | |
|---|---|---|---|---|
| 6,997,137 | B1 * | 2/2006 | Ricke | A01K 1/011 119/165 |
| 7,198,006 | B2 * | 4/2007 | Fischer | A01K 1/0114 119/166 |
| D571,168 | S * | 6/2008 | Sais | D8/1 |
| 8,393,563 | B2 | 3/2013 | Chaoui et al. | |
| 8,646,614 | B2 | 2/2014 | Peterson | |
| 8,684,186 | B2 * | 4/2014 | Westgard | B07B 1/02 209/370 |
| 8,851,014 | B2 * | 10/2014 | Hecht | A01K 1/0114 119/166 |
| 8,943,745 | B2 | 2/2015 | Sexton et al. | |
| 8,944,253 | B2 * | 2/2015 | Ward | B03C 7/006 209/417 |
| 8,955,687 | B1 * | 2/2015 | Dews | B07B 1/02 209/235 |
| 8,966,813 | B2 * | 3/2015 | Petersen | A01C 1/025 264/295 |
| 9,095,881 | B2 * | 8/2015 | Rieck | B07B 1/28 |
| 9,114,429 | B2 * | 8/2015 | Wiherle | B07B 1/02 |
| 2014/0299049 | A1 * | 10/2014 | Constantino, Jr. | A47J 43/22 118/19 |
| 2015/0021238 | A1 | 1/2015 | Gandhi et al. | |

* cited by examiner 10
30
47
60
50
55
54
32
34
40
51
C
C
C

SORTING AND BAGGING APPARATUS AND METHOD

FIELD OF THE INVENTION

This invention relates to a sorting and bagging apparatus. More particularly, the invention relates to an apparatus for sorting a first portion of a product from a second portion of the product and facilitating bagging of the second portion of the product.

BACKGROUND OF THE INVENTION

Since its legalization in several states, the marijuana industry has become one of the largest growing industries in the United States. As a part of this growth, the need to produce and package marijuana has similarly increased. Generally it is desirable to package the marijuana buds separate from the "shake", the small bits of bud that break off of the buds during handling or the like. Generally, sorting of the shake from the marijuana buds has been done either manually or using complex machinery. The manual sorting is very time consuming while complex machinery requires a large monetary investment, which is usually not desirable for small business or home growers. Additionally, even after the shake has been sorted out of the marijuana buds, the buds must still be bagged, which is an additional step with associated additional time and cost.

While marijuana production is described herein as an illustrative application requiring sorting and bagging, it is recognized that other products have a similar need to sort out a first portion of the product and then bag the remaining, second portion of the product.

SUMMARY OF THE INVENTION

In at least one embodiment, the present invention provides a sorting and bagging apparatus including a container defining an internal chamber with an opening thereinto and a lid configured to be positioned on the container. The lid defines a through opening aligned with the opening into the container. A basket extends through the through opening and is supported by the lid. The basket has sidewalls and a bottom surface and at least the bottom surface has a plurality of passages therethrough. A funnel having a funnel body extending between an inlet edge and an outlet edge is secured relative to the basket such that the inlet edge extends along the basket bottom surface wherein a sorting chamber is defined between the basket sidewalls, the basket bottom surface and the funnel. The lid is configured to be tilted such that contents within the sorting chamber pass from the sorting chamber to the funnel and out of the funnel at the outlet edge and into a bag.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION OF THE INVENTION

Figure 1:
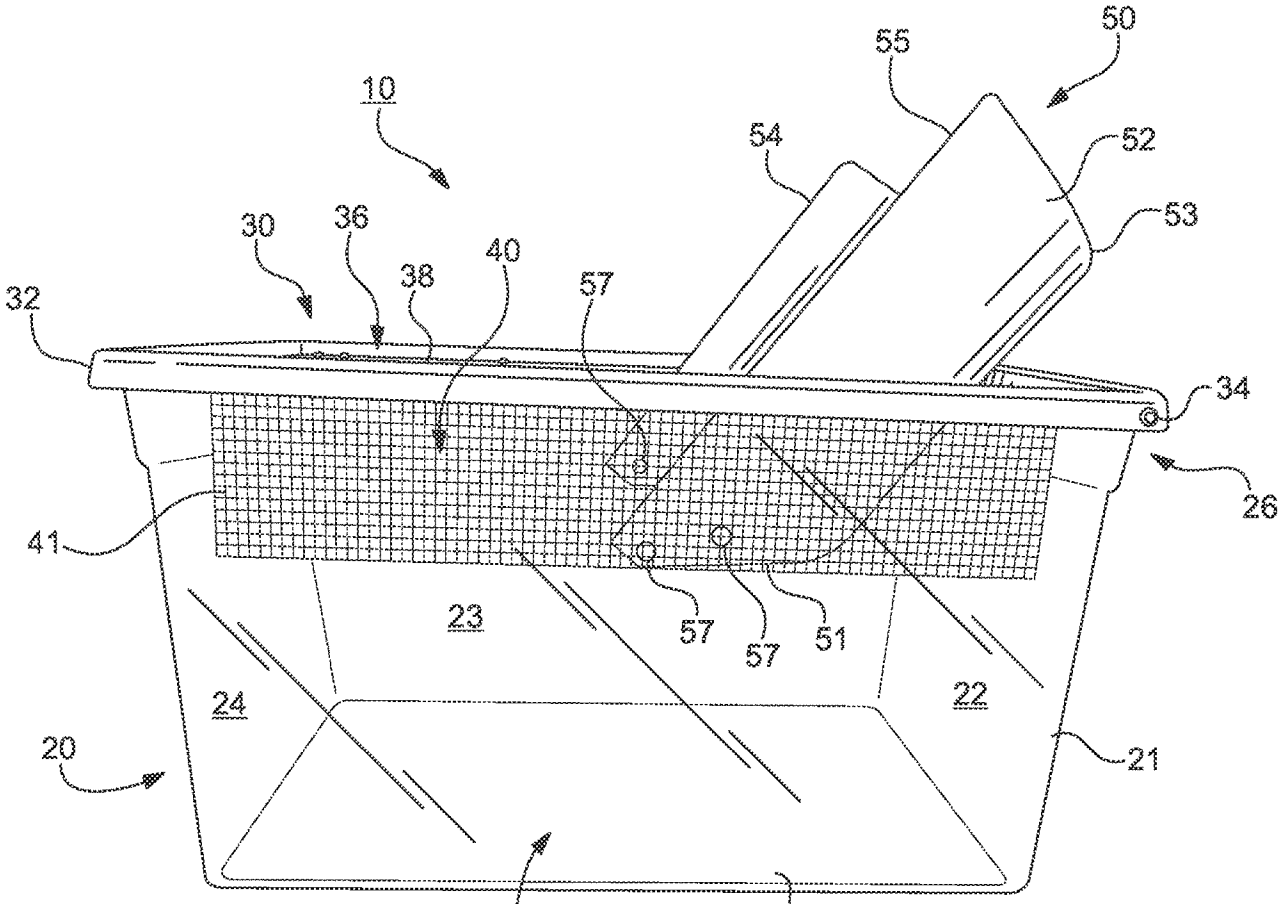
FIG. 1 is a side perspective view of a sorting and bagging apparatus in accordance with an exemplary embodiment of the invention.

In the drawings, like numerals indicate like elements throughout. Certain terminology is used herein for convenience only and is not to be taken as a limitation on the present invention. The following describes preferred embodiments of the present invention. However, it should be understood, based on this disclosure, that the invention is not limited by the preferred embodiments described herein.

Figure 2:
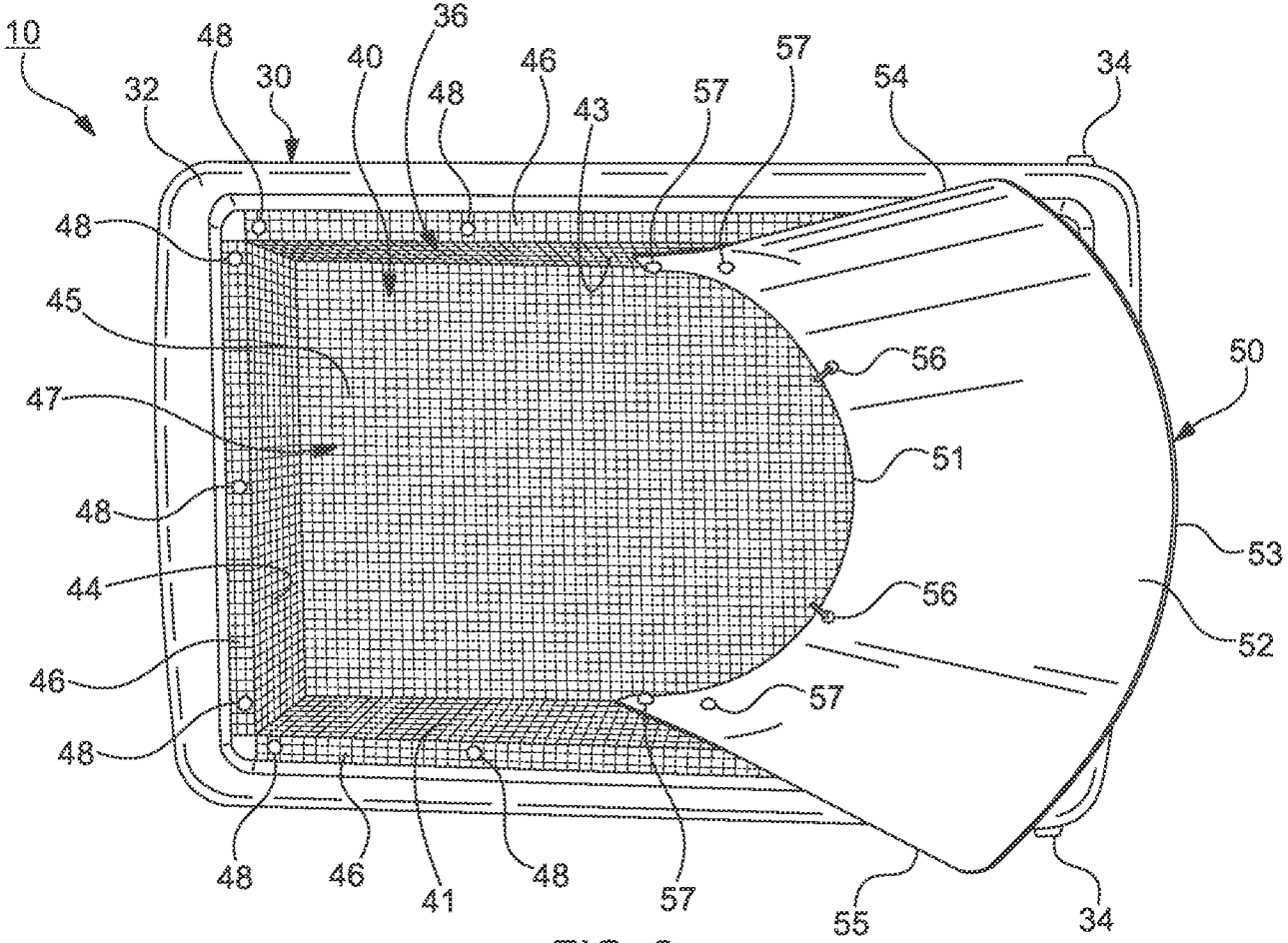
FIG. 2 is a top plan view of the sorting and bagging apparatus of FIG. 1.
Figure 3:
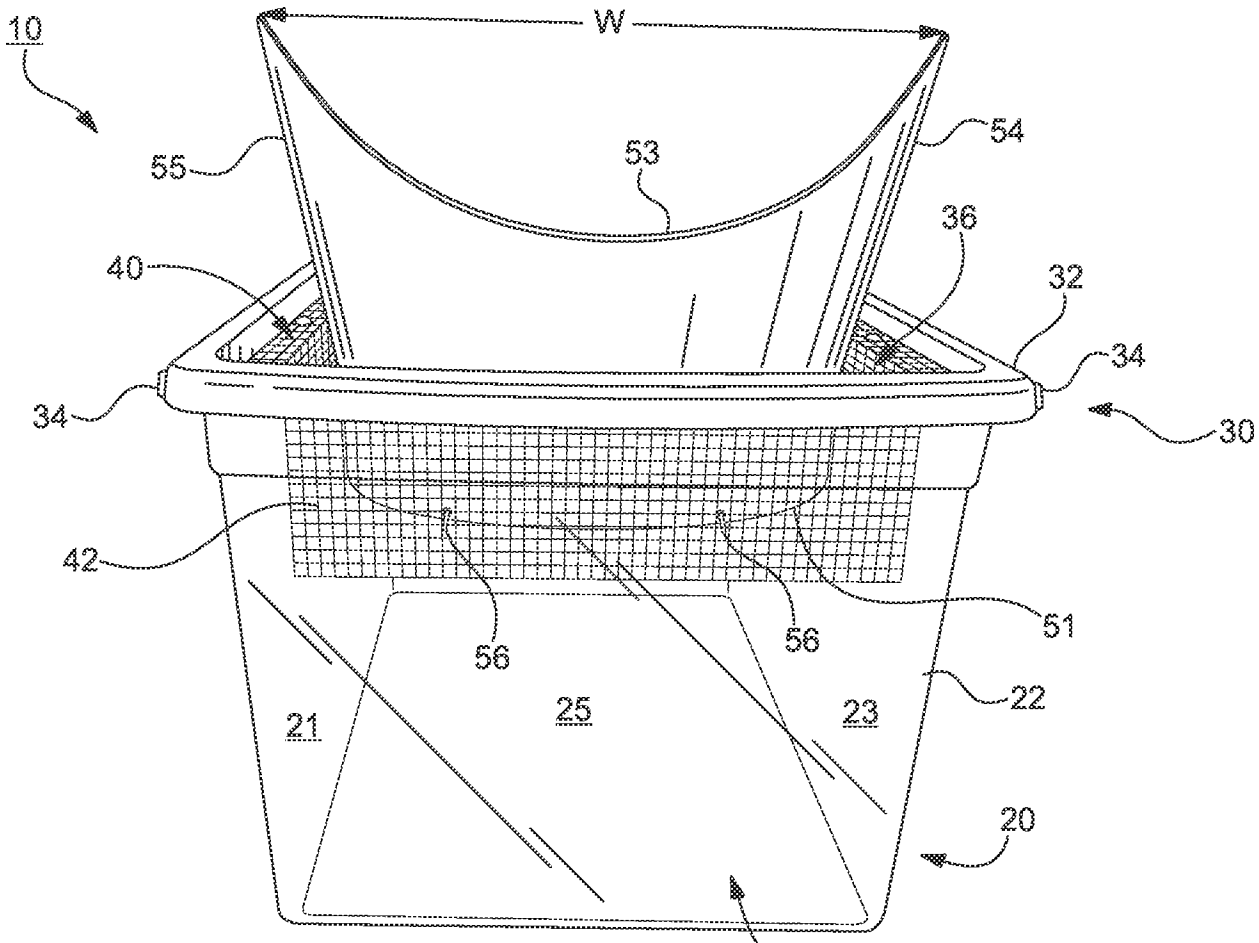
FIG. 3 is an end perspective view of the sorting and bagging apparatus of FIG. 1.

Referring to FIGS. 1-3, a sorting and bagging apparatus 10 in accordance with an exemplary embodiment of the invention will be described. The apparatus 10 generally comprises a container 20, a lid 30, a sorting basket 40 and a funnel 50.

In the illustrated embodiment, the container 20 has four sidewalls 21-24 extending from a bottom surface 25 to a rim 28 about an opening 26. An interior chamber 27 is defined within the container 20 and is in communication with the opening 26. While the container 20 is illustrated as having a rectangular configuration, the invention is not limited to such and the container 20 may have any desired configuration. The container 20 has a depth which is equal to the depth of the basket 40 and a desired storage depth below the basket 40. The desired storage depth can be selected based on the intended product to be sorted and the volume of product desired to be sorted without having to empty the container 20. By way of example only, the basket 40 may have a depth of about 2 inches and the container have a depth of about 7 inches.

The lid 30 includes a rim 32 configured to sit on the rim 28 of the container 20. While it is preferable that the rims 28 and 32 have complementary configurations, such is not necessary. For example, the lid 30 may have a length shorter than the length of the container sidewalls 21 and 23 such that the container defines a larger storage capacity and the lid 30 and basket 40 maintain a desired size for batch sorting. A through opening 36 extends through the lid 30. In the illustrated embodiment, a basket support shoulder 38 extends inward from the rim 32 and defines the through opening 36. The lid 30 is configured to be tilted to empty the contents of the basket 40 into a bag, as will be described in more detail hereinafter. In the illustrated embodiment, opposed pivot pins 34 connect one end of the lid 30 to the container 20, however, other means for tilting the lid 30 relative to the container 20 may be provided, including simply lifting the lid off of the container and tilting the lid.

The basket 40 is configured to extend through the lid through opening 36 and includes a plurality of sidewalls 41-44 extending from a basket bottom surface 45. In the illustrated embodiment, the free edge of each sidewall 41-44 includes a radial flange 46 configured to rest on the lid shoulder 38. Rivets, 48 bolts or the like extend through the flanges 46 and shoulder 38 to secure the basket 40 relative to the lid 30. Other connectors may be utilized to secure the basket 40 relative to the lid 30 either permanently or temporarily, for example, clips or hoop and loop fasteners. To facilitate sorting, at least the basket bottom surface 45 has a mesh configuration, or other passages, such that a portion of the product may pass through the basket 40 and into the container interior chamber 27. In the illustrated embodiment, the sidewalls 41-44 also have a mesh configuration. The size of the mesh or openings is selected such that only intended portions of the product will pass through the basket 40. As one exemplary application wherein the sorting and bagging apparatus 10 is used for marijuana, the mesh is sized to allow shake to pass through into the container, but the buds are retained in the basket. By way of example only, in such an application, the mesh may have openings of approximately ¼ inch.

The funnel 50 includes a body 52 extending between an inlet edge 51, an outlet edge 53 and opposed side edges 54, 55. The funnel 50 is secured relative to the basket 40 such that the inlet edge 51 extends along the basket bottom surface 45 such that a sorting chamber 47 is defined between the basket sidewalls 41, 43 and 44, the funnel 50 and the basket bottom surface 45. The tolerance of contact between the inlet edge 51 and the bottom surface 45 are such that desired product is unlikely to pass therebetween when the lid 30 is tilted such that the material in the basket 40 moves toward the funnel 50. In the illustrated embodiment, the funnel 50 is permanently secured relative to the basket 40 by rivets, bolts 57 or the like on the sides and by wires 56 or the like connecting the inlet edge 51 to the basket bottom surface 45. Other connectors may be utilized to secure the funnel 50 relative to the basket 40 either permanently or temporarily. In one embodiment, pivot pins are utilized to secure the funnel 50 such that the funnel may be pivoted into the basket when not in use. It is noted that while the basket 40 extends beyond the funnel inlet edge 51, i.e. to the sidewall 42, such may not be necessary and the basket 40 may terminate at the inlet edge 51.

Figure 5:
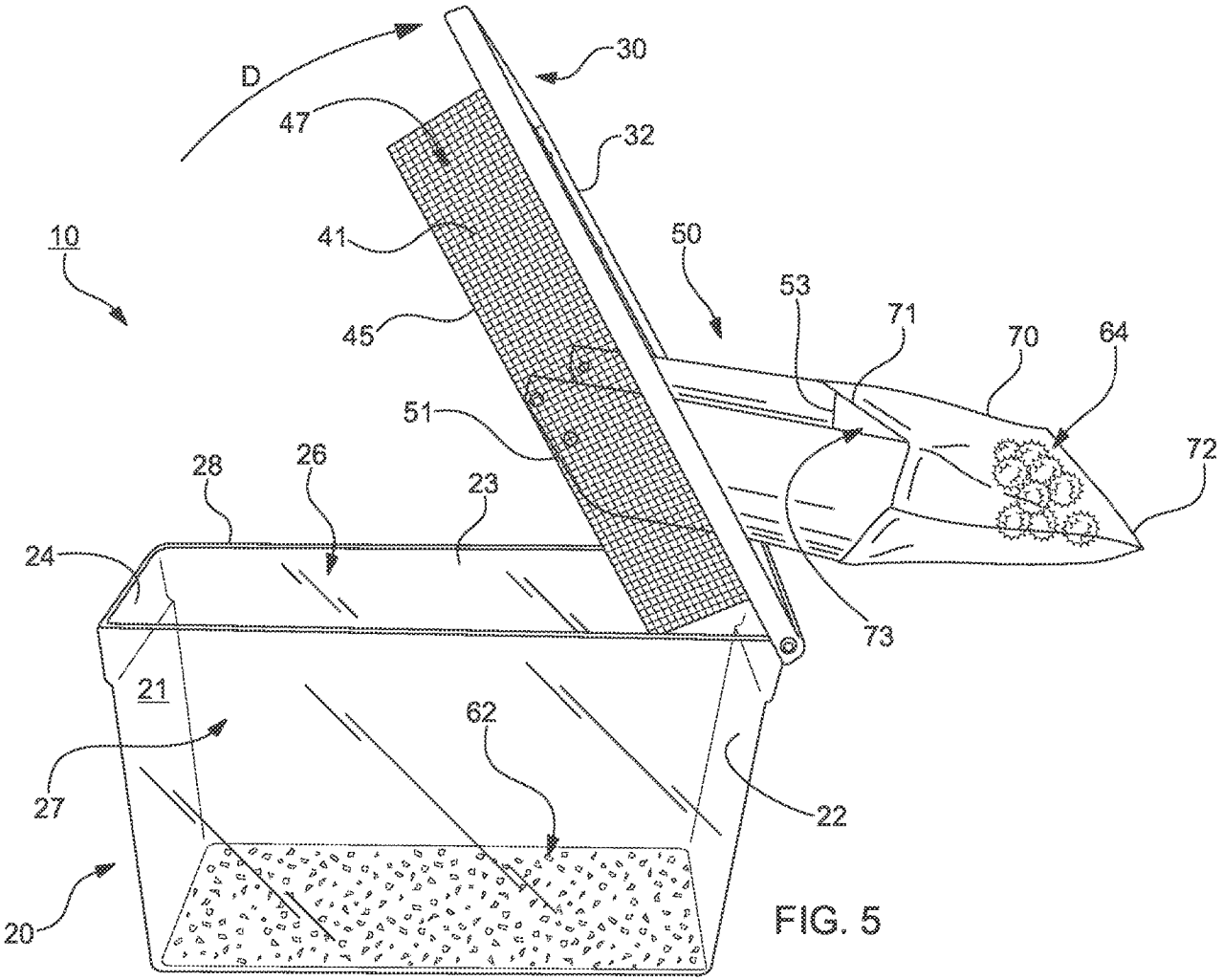
FIG. 5 is a side perspective view of the sorting and bagging apparatus of FIG. 1 with the lid tilted relative to the container to facilitate bagging of a portion of the product.

Referring to FIG. 3, the illustrated funnel body 52 has a semi-cylindrical configuration and the side edges 54 and 55 taper outward such that the outlet edge 53 has a width W and an arcuate configuration. With such a configuration, a bag 70 may be retained on the funnel 50 in an open position with an opening 73 through an end 71 of the bag 70 configured to receive content passing along the funnel 50 as illustrated in FIG. 5. The funnel body 52 preferably has some flexibility to assist with positioning of the outlet edge 51 within and out of the bag opening 73.

Having described the configuration of an exemplary sorting and bagging apparatus 10, an exemplary sorting and bagging procedure will be described with reference to FIGS. 4 and 5. The exemplary procedure is described with respect to sorting of marijuana, however, the invention is not limited to such and other products may be sorted and bagged utilizing the invention.

Figure 4:
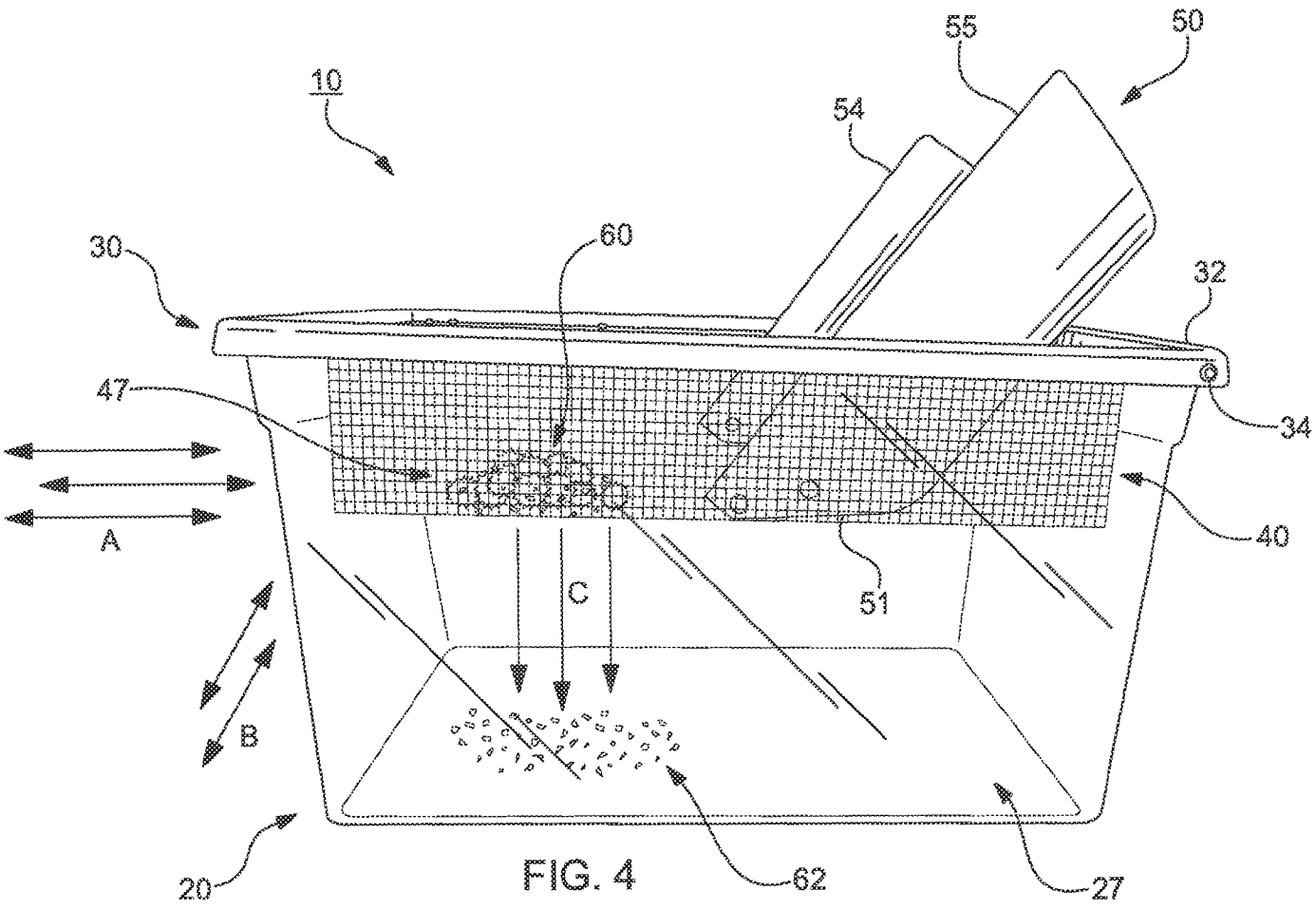
FIG. 4 is a view similar to FIG. 1 illustrating sorting of product.

As shown in FIG. 4, the product 60 to be sorted, for example, marijuana is positioned within the sorting chamber 47 of the basket 40. The apparatus 10 is then shaken forward and back and sideways as indicated by arrows A and B. As the apparatus 10 is shaken, a first portion of the product 62, in the illustrative application, the shake, falls through the openings in the basket 40 as indicated by arrows C. The first portion 62 collects in the internal chamber 27 of the container 20.

Turning to FIG. 5, after the apparatus 10 has been sufficiently shaken, the open end 71 of a bag 70 is positioned on the outlet edge 53 of the funnel 50 such that the funnel 50 is aligned with the opening 73. The lid 30 is then tilted as indicated by arrow D and the second, remaining portion 64 of the product 60, in illustrative application, the buds, slides along the basket bottom surface 45, along the funnel 50 and into the closed end 72 of the bag 70. Once a desired amount of the second product 64 is within the bag 70, the bag 70 is removed and the lid 30 is returned to the original position. If more second product 64 remains, additional bags may be filled. Once the second product 64 is filled into the bags, additional unsorted product 60 may positioned in the basket sorting chamber 47 and the process repeated. Preferably, the internal chamber 27 is sized such that the process may be repeated several times before the container 20 needs to be emptied.

These and other advantages of the present invention will be apparent to those skilled in the art from the foregoing specification. Accordingly, it will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as defined in the claims.

What is claimed is:

1. A sorting and bagging apparatus comprising:

a container having an internal chamber with an opening thereinto;

a lid positioned on the container, the lid having a through opening aligned with the opening into the container;

a basket extending through the through opening and supported by the lid, the basket having sidewalls, a bottom surface and having an opening into the basket, wherein at least the bottom surface has a plurality of passages therethrough; and a funnel having a funnel body extending continuously between an inlet edge and an outlet edge, the funnel secured relative to the basket such that the inlet edge extends along the basket bottom surface and the funnel body extends out of the opening into the basket such that the outlet edge is spaced from the lid, wherein a sorting chamber extends between the basket sidewalls, the basket bottom surface and the funnel;

wherein the lid is tiltable from a sorting position wherein the lid is supported by the container and the basket is within the internal chamber to a tilted position wherein at least a portion of the lid is spaced from the container, and when the lid is in the tilted position, contents within the sorting chamber pass from the sorting chamber to the funnel and out of the funnel at the outlet edge.

2. The sorting and bagging apparatus according to claim 1 wherein the funnel body has a semi-cylindrical configuration and the outlet edge has a width such that a bag may be maintained on the funnel adjacent the outlet edge with the funnel aligned with an opening into the bag.

3. The sorting and bagging apparatus according to claim 2 wherein the funnel body has side edges extending between the inlet edge and the outlet edges and the side edges taper outwardly moving from the inlet edge to the outlet edge.

4. The sorting and bagging apparatus according to claim 1 wherein the funnel is pivotally secured relative to the basket such that the funnel may be pivoted into the basket when not in use.

5. The sorting and bagging apparatus according to claim 1 wherein the funnel is permanently secured relative to the basket.

6. The sorting and bagging apparatus according to claim 1 wherein at least the basket bottom surface is defined by a mesh screen material.

7. The sorting and bagging apparatus according to claim 6 wherein the mesh screen material has an opening size of about ¼ inch.

8. The sorting and bagging apparatus according to claim 6 wherein the basket sidewalls are also defined by the mesh screen material.

9. The sorting and bagging apparatus according to claim 1 wherein a radial flange extends from a free edge of each basket sidewall and is configured to sit upon a lid shoulder defined about the through opening.

10. The sorting and bagging apparatus according to claim 9 wherein fasteners engage the radial flanges and the lid shoulder to secure the basket relative to the lid.

11. The sorting and bagging apparatus according to claim 1 wherein the lid is pivotally connected to the container.

12. The sorting and bagging apparatus according to claim 1 wherein a container rim extends about the container opening and the lid includes a lid rim configured to sit on the container rim.

13. The sorting and bagging apparatus according to claim 12 wherein the container rim and the lid rim have complementary configurations.

* * * * *